United States Patent [19]

Kuntschik

[11] 4,101,431

[45] Jul. 18, 1978

[54] TURBINE LUBRICANT

[75] Inventor: Lawrence F. Kuntschik, Nederland, Tex.

[73] Assignee: Texaco Inc., New York, N.Y.

[21] Appl. No.: 796,104

[22] Filed: May 12, 1977

[51] Int. Cl.[2] ..... C10M 1/48; C10M 3/42; C10M 5/24; C10M 7/46

[52] U.S. Cl. ..... 252/46.7; 252/49.8; 252/389 A; 252/402

[58] Field of Search ..... 252/49.9, 49.8, 46.7, 252/402, 389 A

[56] References Cited

U.S. PATENT DOCUMENTS 3,931,022 1/1976 Chesluk et al. ..... 252/49.9

*Primary Examiner*—Delbert E. Gantz
*Assistant Examiner*—Irving Vaughn
*Attorney, Agent, or Firm*—Thomas H. Whaley; Carl G. Ries; Henry W. Archer

[57] ABSTRACT

Described herein is an extreme pressure turbine lubricant exhibiting improved vapor space rust protection, oxidation stability and air release properties comprising synthetically derived triarylphosphates, benzotriazole, a 2,6-di-t-butylphenol as antioxidant, a phenol-free antirust concentrate and caprylic or capric acid.

10 Claims, No Drawings

TURBINE LUBRICANT

BACKGROUND OF THE INVENTION

1. Field of the Invention

This invention is concerned with a new lubricating composition and method for use in main turbines and gears, auxiliary turbine installations, certain hydraulic equipment and for general mechanical lubrication.

The lubrication of turbine engines, particularly those used in environments containing water, requires lubricants which exhibit effective rust inhibition both during engine operation and while idle. In addition these lubricants must provide the desired oxidation stability, air release, and extreme pressure/antiwear properties.

The compositions of the invention exhibit excellent vapor space rust protection, improved oxidation stability, extreme pressure/antiwear, and air release properties.

2. State of the Art

The compositions of the present invention constitute an improvement over those disclosed and claimed in coassigned U.S. Pat. No. 3,931,022 issued Jan. 6, 1976. The compositions patented therein contain a mineral lubricating oil containing from 0.02 to 3.0 weight percent of a vapor space rust inhibitor such as a $C_8$–$C_{10}$ aliphatic carboxylic acid; 0.01 to 0.3 wt.% of a substituted heterocyclic antioxidants such as benzotriazole; 0.05 to 1.0 wt.% of a rust inhibitor such as alkyl-succinic acid/alkyl acid phosphate/phenol; 0.001 to 0.500 wt.% of a polymeric antifoamant such as a polyacrylate; 0.01 to 5.0 wt.% of a tricresylphosphate; and 0.01 to 2.00 wt.% of a hindered alkyl phenol antioxidant such as 4-methyl-2,6-di-t-butylphenol.

Differences over the Prior Art

Listed below are the differences distinguishing the present compositions from those of U.S. Pat. No. 3,931,022:

1. The tricresylphosphates used as the extreme pressure additives in the patent are derived from naturally occurring cresylic acids and are in short supply as well as expensive. In the present invention, those are replaced without adverse effect by a mixture of synthetically derived triarylphosphates.

2. The present formulations incorporate 2,6-ditertiary alkylphenols as their primary antioxidants. These compounds provide superior oxidation inhibition when used alone or synergistically with substituted triazoles as compared with the 4-substituted phenol of the Patent.

3. The present formulations contain an anti-rust concentrate which unlike that of the patent is phenol-free. This concentrate eliminates the use of a potentially hazardous material and is less expensive.

SUMMARY OF THE INVENTION

The present invention discloses a vapor phase rust inhibiting, oxidation stable, lubricating composition having improved vapor space rust protection air release properties and comprising in combination, a major amount of a mineral lubricating oil having an SUS viscosity at 100° F. between 70 and 5000; a minor effective oxidation stabilizing amount of a heterocyclic anti-oxidant compound of the formula:

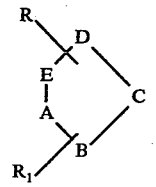

wherein R and $R_1$ are alkyl, or aryl, straight or branched chain, or form a six membered ring and have one to 30 carbon atoms each; or can be absent and at least one member of the group ABCDE is carbon and at least three other members are selected from the group of nitrogen, oxygen and sulfur; a minor effective antifoaming amount of an antifoaming-air release agent; a minor effective vapor phase rust inhibiting amount of 9 $C_8$ to $C_{10}$ monocarboxylic acid; a minor work load improving amount of a mixture of synthetic triaryl phosphates; a minor effective antioxidant amount of an alkylphenol antioxidant; and a minor effective antirust amount of a phenol-free antirust concentrate consisting essentially of alkyl maleic acid in diluent oil and a mixture of dodecyldihydrogen phosphate and didodecyl hydrogen phosphate.

The compositions of the invention meet the requirements of MIL-L-17731F Amendment 2 and MIL-L-24467 Specifications.

In the present compositions 0.02 to 3.0 weight percent of $C_8$–$C_{10}$ acids are used to provide vapor space rust inhibition and can be of nominal 90–100% purity. Capric, caprylic and pelargonic acids are preferred. It has been noted that these acids tend to degrade the oxidation stability of a lubricating oil when used alone therewith. However, this effect can be overcome by using a secondary oxidation inhibitor such as benzotriazole. Other compounds which can be used are tolutriazole, dihydroxy benzotriazole, alkyl aminotriazoles such as dodecyl-2-amino-1,3,4-triazole and other substituted heterocyclic compounds such as those represented by the general structure represented by the general structure listed below:

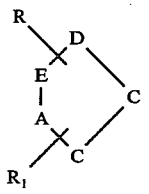

wherein R and $R_1$ can be alkyl or aryl, straight or branched chain, R and $R_1$ can be cyclic constituting a six membered ring e.g., benzene or a substituted benzene ring. R and $R_1$ can contain from one to 30 carbon atoms each but are preferably from 3 to 21 carbon atoms.

At least one member of the ring ABCDE should be carbon, but preferably A and E. The other members can be N, O or S or any combination of the three atoms. It is preferable that at least one of the atoms be nitrogen. Encompassed within this definition are:

1,2,3-triazole; 1,2,4-triazole; 1,2,4-oxadiazole; 1,2,5-oxadiazole; 1,3,4-oxadiazole; 1,2,3,4-oxatriazole; 1,2,3,5-oxatriazole; 1,2,3-dioxazole; 1,2,4-dioxazole; 1,3,2-dioxazole; 1,3,4-dioxazole and 1,2,5-oxathiazole. These are used in an amount of 0.001 to 0.3 weight percent.

The antirust concentrate (ARC w/o phenol hereinafter) is phenol-free and contains oil soluble polycarboxylic acids with alkyl groups of 6 to 30 carbon atoms and preferably 8 to 20 carbon atoms. Such acids include $C_8$ to $C_{20}$ alkyl or alkenyl malonic, succinic, glutaric, adipic and pimelic acids with the $C_{10}$, $C_{12}$, $C_{14}$, $C_{16}$, $C_{18}$ and $C_{20}$ alkenyl succinic acids being preferred. In the compositions listed below the concentrate is a mixture of 92.3 wt. percent of a 50—50 weight mixture of $C_{12}$ alkyl-maleic acid in an oil having a sp. gr. of 0.88, a gravity API of 29 and a vis. at 100F of 100 SUS and 7.7 weight percent of alkyl acid orthophosphate. The concentrate comprises from 0.05 to 1.0 weight percent of the composition.

The antifoamant preferably is poly(2-ethylhexyl) acrylate in the form of a 40% kerosene solution. This additive provides air release as well as antifoamant properties. Other suitable antifoamant agents include the customary dimethyl silicone polymers, however, these antifoamants do not afford adequate air release properties. These are used in an amount of 0.001 to 0.500 weight percent.

The present compositions contain from 0.01 to 5.0 weight percent of a mixture of synthetic triaryl phosphate which serve as load carrying additives. Preferred among these is a product marketed under the trade marked name of "Kronitex 100" or "Syn-O-Ad 8485" and identified generically as a tri(isopropylated phenol)-phosphate. More specifically, "Kronitex 100" is [tri(isopropylphenyl)phosphate].

The triarylphosphate is preblended with 0.83 wt.% benzotriazole prior to blending with the final product because of the insolubility of benzotriazole in mineral oil.

The oxidation inhibitor used is a 2,6-ditertiary-alkylphenol preferably 2,6-ditertiarybutylphenol which is sold under the trademarked name of "Ethyl Antioxidant 701". The antioxidant is used in an amount of 0.01 to 2.00 weight percent.

The base oil is a mineral lubricating oil having an SUS viscosity at 100° F ranging from 70 to 5000.

Preferred compositions of this invention are tabulated below. Test results demonstrating their effectiveness for the purposes stated and comparing same with a composition, described in U.S. Pat. No. 3,931,022 are presented in Tables I and II.

The test procedures are as follows:

Reflux Rust Test Procedures

The reflux rust tests used herein incorporated modifications of the method described in MIL-L-24467 Appendix B. The test oil (5 ml), distilled water (50 ml), and a boiling chip are placed in a 250 ml Erlenmeyer flask. A polished steel specimen (¾ inch × ¾ inch × ¼ inch thick) is suspended from a glass cover (with a platinum wire) in the vapor space above the oil/water. The flask and contents are heated in an oil bath for the duration of the test. After the test, the specimen is inspected for the presence of rust.

Blends Nos. I and T were also tested in accordance with the MIL-L-24467 Appendix B Procedure (48 hr/230°-240° F) and yielded no rust in this test.

TABLE I

| | TURBINE OIL FORMULATIONS CONTAINING MDBP | | | | | | |
|---|---|---|---|---|---|---|---|
| Blend No. | A | B | C | D | E | F | G |
| Composition, Wt. % | | | | | | | |
| Mineral Oil | | | | Balance | | | |
| Tricresylphosphate | 2.0 | 2.0 | — | — | 2.0 | 2.0 | 2.0 |
| Triarylphosphate[1] | — | — | 2.0 | 2.0 | — | — | — |
| MDBP | 0.3 | 0.3 | 0.3 | 0.3 | 0.3 | 0.3 | 0.3 |
| 3.4-methyl-2,6-di-t-butyl-phenol | | | | | | | |
| ARC | 0.05 | 0.05 | — | — | 0.05 | 0.05 | 0.05 |
| ARC w/o Phenol | — | — | 0.05 | 0.05 | — | — | — |
| Caprylic acid | — | — | — | — | — | 0.10 | — |
| Benzotriazole | — | — | — | — | — | — | 0.017 |
| Dimethyl silicone antifoam, ppm | (50) | (50) | (50) | (50) | — | (50) | (50) |
| Polyacrylate antifoam, ppm | — | — | — | — | (50) | — | — |
| Test Results | | | | | | | |
| RBOT, min. | 175 | 192,189 | 212,182 | 201 | 200,208 | 112,162 | 250 |
| ASTM Oxidation, 1000hr | | | | | | | |
| Neut. No. | 0.10,0.10 | 0.03,0.05 | 0.1 | 0.1 | 0.1,0.10 | 0.2,0.5 | — |
| mg Sludge | 74.4,120.3 | 40,2882 | 139 | 69 | 61.0,58.2 | — | — |
| Military Rust | Pass | Pass | Pass | Pass | Borderline | — | Pass |
| D665 Rust, DW | — | — | Pass | Pass | — | | — |
| SSW | — | — | Pass | Pass | — | — | — |
| Reflux Rust, 48hr/180° F | — | — | — | — | — | Trace Rust[2] | Fail[2] |
| LA Air Release | 170 | 150,155 | — | — | 22,18 | — | — |
| Ryder Gear, ppi | — | 2300 | — | 2337 | 2310 | — | 2540 |
| Navy Work Factory | — | 0.972 | — | — | 0.98 | 0.60 | 0.964 |

| Blend No. | H | I | J | K | L |
|---|---|---|---|---|---|
| Composition, Wt.% | | | | | |
| Mineral Oil | ← | | Balance | | → |
| Tricresylphosphate | 2.0 | 2.0 | 2.0 | 2.0 | 1 |
| Triarylphosphate[1] | — | — | — | — | 0.3 |
| MDBP | 0.3 | 0.3 | 0.3 | 0.3 | 0.3 |
| ARC | 0.05 | 0.10 | 0.10 | 0.1 | 0.1 |
| ARC w/o Phenol | — | — | — | | |
| Caprylic acid | 0.10 | 0.075 | 0.075 | 0.075 | 0.075 |
| Benzotriazole | 0.017 | 0.017 | 0.017 | 0.017 | 0.017 |
| Dimethyl silicone antifoam, ppm | (50) | — | — | — | — |
| Polyacrylate antifoam, ppm | — | (50) | (50) | (50) | (50) |
| Test Results | | | | | |
| RBOT, min. | 322,252 | 327 | 325,248 | 270,360 | 312,298 |
| ASTM Oxidation, 1000hr | | | | | |
| Neut. No. | — | 0.05,0.07 | — | — | — |

TABLE I-continued

| | | | | | |
|---|---|---|---|---|---|
| mg. Sludge | — | 73,77.8,92.2, | 137.8 | — | — |
| D665 Rust, DW | — | — | Pass | Pass | Pass |
| SSW | — | — | Pass | Pass | Pass |
| REflux Rust, 48hr/180° F | No Rust[2] | No Rust | No Rust | No Rust | — |
| LA Air Release | — | 17 | — | — | — |
| Ryder Gear, ppi | | 2222,2443 | — | — | — |
| Navy Work Factor | 0.939 | 0.97 | — | — | — |

[1]Kronitex 100 used in this work
[2]Reflux Rust, 20 hr/210° F

TABLE II

TURBINE OIL FORMULATIONS CONTAINING ETHYL ANTIOXIDANT 701

| Blend No. | M | N | O | P | Q | R | S |
|---|---|---|---|---|---|---|---|
| Composition, Wt. % | | | | | | | |
| Mineral Oil | ← | | | Balance | | | → |
| Tricresylphosphate | — | — | 2.0 | 2.0 | 2.0 | 2.0 | — |
| Triarylphosphate[1] | 2.0 | 2.0 | — | — | — | — | 2.0 |
| Ethyl Antioxidant 701 | 0.3 | 0.3 | 0.3 | 0.3 | 0.3 | 0.3 | 0.3 |
| ARC | 0.05 | — | 0.05 | — | 0.1 | 0.1 | 0.1 |
| ARC w/o Phenol | — | 0.05 | — | 0.05 | — | — | — |
| Caprylic acid | — | — | — | — | 0.075 | 0.075 | 0.075 |
| Benzotriazole | — | — | — | — | 0.017 | 0.017 | 0.017 |
| Dimethyl silicone antifoam, ppm | (50) | (50) | (50) | (50) | — | — | — |
| Polyacrylate antifoam, ppm | — | — | — | — | (50) | (50) | (50) |
| Test Results | | | | | | | |
| RBOT, min. | 302,299 | 382 | 368,350 | 347,365 | 422,487 | 536,504 | 414,389 |
| ASTM Oxidation, 10000hr | | | | | | | |
| Neut. No. | 0.4 | 0.1 | 0.10 | 0.1 | — | — | 0.64,1.0 |
| mg Sludge | 24.1 | 18.0 | 24.8 | 39.2 | — | — | 28.2,103.7 |
| Military Rust | Pass | Pass | Pass | Pass | | | Pass |
| D665 Rust, DW | Pass | Pass | Pass | Pass | Pass | Pass | Pass |
| SSW | Pass | Pass | Pass | Pass | Pass | Pass | Pass |
| Reflux Rust, 48hr/180° F | — | — | — | — | | No Rust | No Rust |
| LA Air Release | — | — | — | — | — | — | 27 |
| Ryder Gear, ppi | 2574 | 2250 | 2394 | 2582 | — | — | — |
| Navy Work Factor | 0.997 | — | 0.977 | — | — | — | 0.998 |

| Blend No. | T | U | V |
|---|---|---|---|
| Composition, Wt. % | | | |
| Mineral Oil | ← | Balance | → |
| Tricresylphosphate | — | 2.0 | |
| Triarylphosphate[1] | 2.0 | — | 2.0 |
| Ethyl Antioxidant 701 | 0.3 | 0.3 | 0.3 |
| ARC | — | — | 0.1 |
| ARC w/o Phenol | 0.1 | 0.1 | — |
| Caprylic acid | 0.075 | 0.075 | 0.075 |
| Benzotriazole | 0.017 | 0.017 | — |
| Dimethyl silicone antifoam, ppm | — | — | — |
| Polyacrylate antifoam, ppm | (50) | (50) | (50) |
| Test Results | | | |
| RBOT, min. | 523 | 432,475 | 437,260 |
| ASTM Oxidation, 1000hr | | | |
| Neut. No. | 0.3,0.4 | — | — |
| mg Sludge | 44.5,67.4 | — | — |
| Military Rust | Pass | — | Pass |
| D665 Rust, DW | Pass | Pass | Pass |
| SSW | Pass | Pass | Pass |
| Reflux Rust, 48hr/180° F | No Rust | No Rust | Trace Rust |
| LA Air Release | 8 | — | |
| Ryder Gear, ppi | 2370 | | |
| Navy Work Factor | 0.971 | | |

[1]Kronitex 100 used in this work.

The novel feature of this invention is the improvement in oxidation stability (as measured by the Rotating Bomb Oxidation Test - RBOT) obtained (1) with Ethyl Anti-oxidant 701 (2,6-di-t-butylphenol) compared to MDBP and (2) more importantly by the syngergistic effect of a 2,6-ditertiary alkylphenol and benzotriazole. Comparison of the data in Tables I and II, attached, clearly demonstrates these points. These data also show that (1) synthetic triarylphosphate (i.e. Kronitex 100) is as effective as tricresylphosphate obtained from naturally occurring cresylic acids (2) removal of phenol from antirust concentrate does not adversely affect the rust inhibiting properties (3) caprylic acid provides effective vapor space rust inhibition and its deleterious effect on oxidation stability is countered by the claimed synergistic oxidation inhibitor, and that (4) a polyacrylate antifoamant is required for good air release properties as compared to silicone antifoamants.

It will be appreciated that other known lubricating oil additives also can be incorporated in the formulations of the invention to impart thereto additional properties.

Thus there will now be obvious to those skilled in the art many modifications and variations of the compositions set forth above. These modifications and variations will not depart from the scope of the invention, however, as defined by the following claims.

What is claimed is:

1. A vapor phase rust inhibited, oxidation stable, lubricating composition having improved air release properties and comprising in combination, a major amount of a mineral lubricating oil; a minor effective oxidation stabilizing amount of a heterocyclic antioxidant compound of the formula:

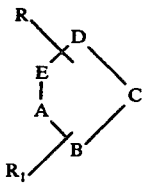

wherein R and $R_1$ are alkyl or aryl, straight or branched chain, or form a six membered ring and have one to 30 carbon atoms each; or can be absent and at least one member of the group ABCDE is carbon and at least three other members are selected from the group of nitrogen, oxygen and sulfur, a minor effective antifoaming amount of a polyacrylate anti-foaming agent, a minor effective vapor phase rust inhibiting amount of a $C_8$ to $C_{10}$ monocarboxylic fatty acid, a minor work load improving amount of a mixture of synthetic tri(isopropylated phenol) phosphates, a minor effective antioxidant amount of a 2,6-ditertiary alkyl phenol antioxidant and a minor effective antirust amount of a phenol-free antirust concentrate consisting of oil-soluble polycarboxylic acids having alkyl groups of 6 to 30 carbon atoms and alkylacid orthophosphates.

2. A composition in accordance with claim 1 wherein the monocarboxylic acid is caprylic acid.

3. A composition in accordance with claim 1 wherein the monocarboxylic acid is pelargonic acid.

4. A composition in accordance with claim 1 wherein the monocarboxylic acid is capric acid.

5. The composition of claim 1 wherein said antioxidant is 2,6-ditertiarybutylphenol.

6. A composition in accordance with claim 1 wherein said heterocyclic antioxidant is benzotriazole.

7. A composition in accordance with claim 1 containing:

| | Percent Weight |
|---|---|
| (Anti-rust concentrate) consisting of polycarboxylic acids having 6 to 30 carbon atoms and alkyl acid orthophosphates | 0.05 to 1.0 |
| 2,6ditertiarybutylphencl | 0.01 to 0.20 |
| tri(isopropylated phenol) | 0.01 to 5.00 |
| $C_8$ to $C_{10}$ monocarboxylic fatty acid | 0.02 to 3.00 |
| benzotriazole | 0.001 to 0.30 |
| polyacrylate antifoamant | .001 to 0.500 |
| Mineral oil | Balance. |

8. The composition of claim 7, wherein said antirust concentrate consists of alkylmaleic acid in diluent oil with a mixture of dodecyldihydrogen phosphate and didodecyldihydrogen phosphate.

9. A composition according to claim 1 containing:

| | Percent weight |
|---|---|
| Anti-rust concentrate consisting of polycarboxylic acids having 6 to 30 carbon atoms and alkyl acid orthophosphates | 0.1 |
| 2,6-ditertiarybutylphenol | 0.3 |
| tri(isopropylphenyl) phosphates | 2.0 |
| caprylic acid | 0.075 |
| benzotriazole | 0.017 |
| poly(2-ethylhexyl) acrylate antifoamant ppm | 50 |
| Mineral Oil | Balance. |

10. The composition of claim 1 wherein said oil has an SUS viscosity at 100° F ranging from 70 to 5000.

* * * * *